US009661945B2

(12) United States Patent
DeNinno et al.

(10) Patent No.: US 9,661,945 B2
(45) Date of Patent: May 30, 2017

(54) DOUBLE WALLED DRINKING VESSEL WITH ANTI-ROTATION DECORATIVE WRAP

(71) Applicant: Tervis Tumbler Company, North Venice, FL (US)

(72) Inventors: Gregory Peter DeNinno, Venice, FL (US); Dham Vayalur, Venice, FL (US); Lindsey Suzanne Hamner, Punta Gorda, FL (US)

(73) Assignee: Tervis Tumbler Company, North Venice, FL (US)

( * ) Notice: Subject to any disclaimer, the term of this patent is extended or adjusted under 35 U.S.C. 154(b) by 518 days.

(21) Appl. No.: 14/327,989

(22) Filed: Jul. 10, 2014

(65) Prior Publication Data

US 2016/0007781 A1 Jan. 14, 2016

(51) Int. Cl.
*A47G 19/22* (2006.01)
*B65D 81/38* (2006.01)

(52) U.S. Cl.
CPC ..... *A47G 19/2288* (2013.01); *A47G 19/2227* (2013.01); *B65D 81/3869* (2013.01)

(58) Field of Classification Search
CPC ..... A47G 19/2288; A47G 19/2227; B65D 81/3869
USPC ..... 206/457, 459.5; 220/592.09, 592.17, 220/592.27; 40/310, 324
See application file for complete search history.

(56) References Cited

U.S. PATENT DOCUMENTS 2,984,035 A * 5/1961 Nalle, Jr. ..... A47G 19/2227 215/13.1
4,928,412 A * 5/1990 Nishiyama ..... A47G 19/2227 40/324
5,275,277 A * 1/1994 Gallegos ..... A47G 19/2227 206/217
5,557,867 A * 9/1996 Sugawara ..... G09F 11/30 40/430
5,894,948 A * 4/1999 Yeh ..... A47G 19/2227 215/12.1
6,216,856 B1 * 4/2001 Park ..... B43M 99/003 206/214
6,241,095 B1 * 6/2001 Yencheng ..... B65D 11/16 206/459.1
6,467,644 B1 * 10/2002 Yeh ..... A47G 19/2227 215/10

(Continued)

OTHER PUBLICATIONS

International Search Report for PCT/US2015/039652 dated Sep. 29, 2015.

*Primary Examiner* — Steven A. Reynolds
(74) *Attorney, Agent, or Firm* — Caesar Rivise, PC

(57) ABSTRACT

An insulated decorated drinking vessel having an inner vessel located within an outer vessel and a decorative insert located in an annular space between the inner and outer vessels. The annular space includes a first stop member projecting therein and a second stop member projecting therein. The decorative insert is a curved member having a top edge portion from which a first and second tabs project. The first tab is arranged to engage the first stop member on one side of the first stop member and the second tab is arranged to engage the second stop member on a corresponding side of the second stop member, whereupon the decorative insert is held in place within the annular space and precluded from rotating therein.

14 Claims, 2 Drawing Sheets

(56) References Cited

U.S. PATENT DOCUMENTS

| | | | | |
|---|---|---|---|---|
| 2003/0038132 | A1 | 2/2003 | Zilberman | |
| 2003/0196924 | A1* | 10/2003 | Zilberman | A47G 19/2227 206/459.5 |
| 2006/0102582 | A1* | 5/2006 | Wakefield | A47G 19/2227 215/12.1 |
| 2009/0173652 | A1* | 7/2009 | Chen | A47G 19/2227 206/457 |
| 2011/0114647 | A1* | 5/2011 | Hallberg | A47G 19/2227 220/592.17 |
| 2015/0158658 | A1* | 6/2015 | Anelevitz | A47G 19/2227 220/592.24 |

* cited by examiner

Fig. 1
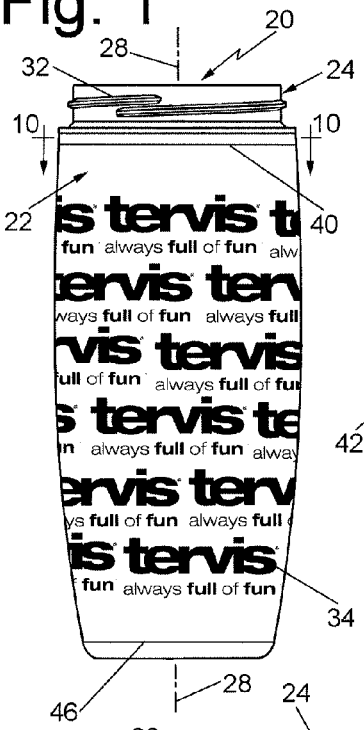
Fig. 2
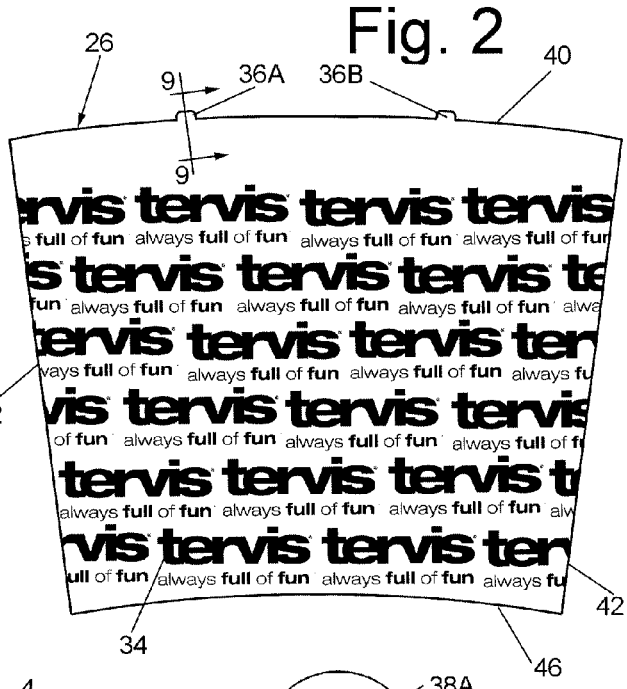
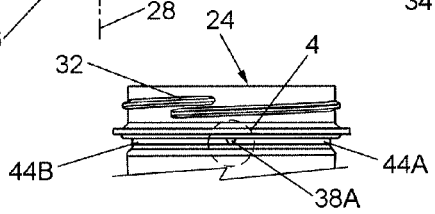
Fig. 3
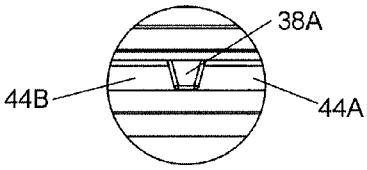
Fig. 4
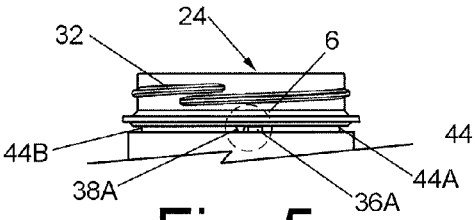
Fig. 5
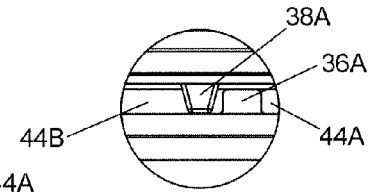
Fig. 6

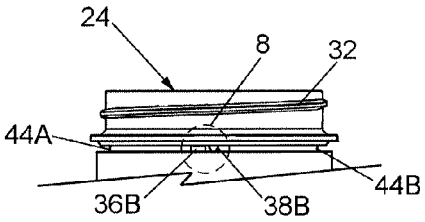
Fig. 7
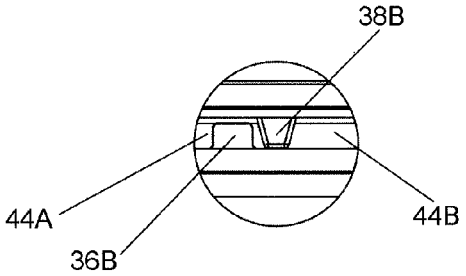
Fig. 8
Fig. 9
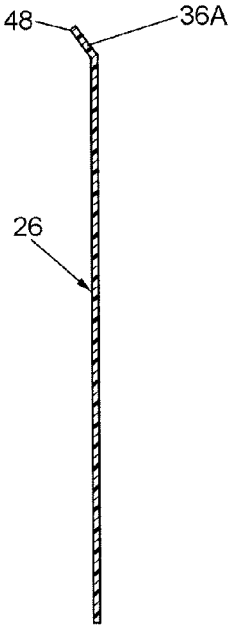
Fig. 10
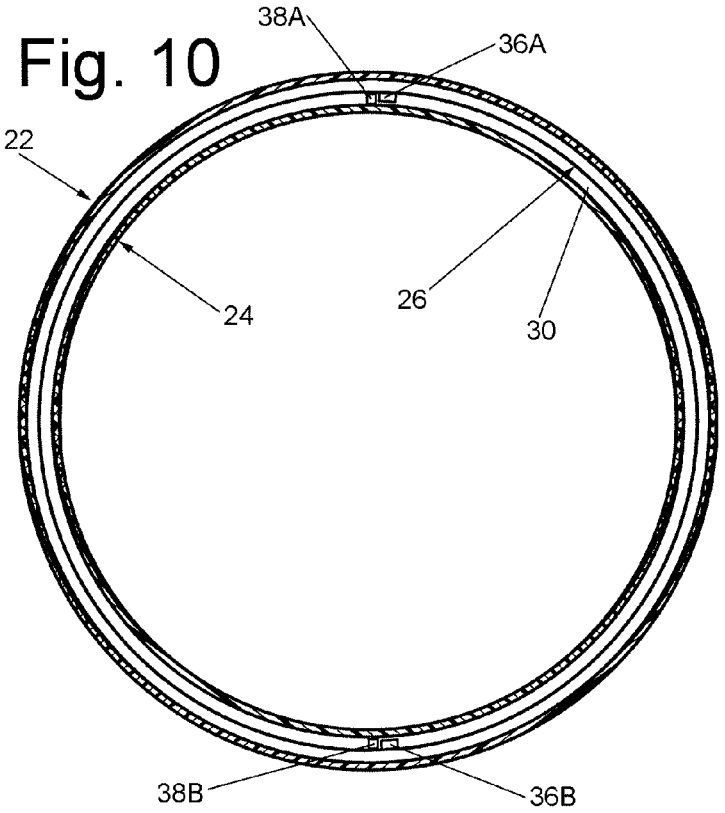

DOUBLE WALLED DRINKING VESSEL WITH ANTI-ROTATION DECORATIVE WRAP

CROSS-REFERENCE TO RELATED APPLICATION

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to drinking vessels and more particularly to insulated vessels having an inner vessel located within an outer vessel with an insulation space therebetween in which a decorative wrap is located.

BACKGROUND OF THE INVENTION

Many double walled drinking vessels are commercially available from various sources, including Tervis Tumbler Company, the assignee of this invention. Such vessels typically are formed of an inner vessel located within and spaced from outer vessel by an annular air or vacuum space to thermally insulate the inner vessel from the ambient atmosphere. Some of such double walled vessels are decorated by use of a decorative wrap which is rolled up and disposed within the annular insulating space.

For many applications it is desired that the double walled vessel and its decorated wrap be constructed so that the placement of the decorated wrap inside the annular space can be achieved easily, effectively and consistently within a small tolerance so that when the vessel has been assembled, the wrap is prevented from rotating within the annular space. The subject invention addresses that need.

SUMMARY OF THE INVENTION

In accordance with one aspect of the invention there is provided a decorated drinking vessel comprising an inner vessel, an outer vessel and a decorated insert. The inner vessel has a circular sidewall extending about a central longitudinal axis. The circular sidewall of the inner vessel has an outer surface. The outer vessel has a circular sidewall extending about the central longitudinal axis. The circular sidewall of the outer vessel has an inner surface. The inner vessel is disposed within the outer vessel with the outer surface of the inner vessel spaced from the inner surface of the outer vessel to form a hollow annular space therebetween. The annular space includes a first stop member projecting therein and a second stop member projecting therein. The decorative insert is a curved member having a top edge portion and a bottom edge portion. One of the top edge portion and the bottom edge portion has a first tab projecting therefrom and a second tab projecting therefrom. The first tab is arranged to engage the first stop member on one side of the first stop member and the second tab is arranged to engage the second stop member on a corresponding side of the second stop member, whereupon the decorative insert is held in place within the annular space and precluded from rotating about the central longitudinal axis.

DESCRIPTION OF THE DRAWING

FIG. 1 is a side elevation view of a portion of an exemplary double walled drinking vessel, e.g., an insulated bottle, constructed in accordance with the teaching of this invention;

FIG. 2 is a top plan view of an exemplary decorated wrap, forming a portion of the bottle of FIG. 1;

FIG. 3 is side elevation view of the top portion of an inner vessel forming a portion of the bottle of FIG. 1;

FIG. 4 is an enlarged view of a stop portion of the bottle shown within the circle designed by the number 4 in FIG. 3;

FIG. 5 is a view similar to FIG. 3, but showing a first tab of the decorated wrap engaging the stop portion of the bottle shown in FIG. 4;

FIG. 6 is an enlarged view of the stop portion of the bottle shown within the circle designed by the number 6 in FIG. 5;

FIG. 7 is a view similar to FIG. 5, but showing a second tab of the decorated wrap engaging another stop portion of the bottle;

FIG. 8 is an enlarged view of the stop portion of the bottle shown within the circle designed by the number 8 in FIG. 7;

FIG. 9 is a greatly enlarged cross-sectional view of the portion of the decorated wrap taken along 9-9 of FIG. 2; and FIG. 10 is an enlarged sectional view taken along line 10-10 of FIG. 1.

DETAILED DESCRIPTION OF THE PREFERRED EMBODIMENT

Referring now to the various figures of the drawing wherein like reference characters refer to like parts, there is shown at 20 in FIG. 1 one exemplary embodiment of a portion of an insulated decorated bottle constructed in accordance with this invention. It must be pointed out at this juncture that the bottle 20 is merely illustrative of numerous double walled decorated vessels that can be constructed in accordance with this invention. Thus, in this exemplary embodiment the complete bottle includes a bottle assembly 20 and a lid assembly (not shown, but which will be described later).

The bottle assembly 20 is best seen in FIGS. 1 and 10 and basically comprises an assembly of a hollow outer body or vessel 22, a hollow inner body or vessel 24 (FIG. 10), and a decorative wrap 26. The outer vessel 22 is a hollow member having a sidewall which is a body of revolution extending about a central longitudinal axis 28. The outer vessel can be formed in any manner, e.g., it can be blow molded or injection molded of any suitable plastic material. The hollow inner vessel 24 is also a hollow member having a sidewall which is a body of revolution extending about the central longitudinal axis 28. The outer vessel can also be formed in any manner, e.g., it can be blow molded or injection molded of any suitable plastic material (e.g., the same plastic material as the vessel 22 or some other material).

Each vessel includes an inner surface and an outer surface. The inner vessel 24 is located within the outer vessel so that its outer surface is disposed opposite and confronting the inner surface of the outer vessel, but is spaced slightly therefrom to form an annular thermally insulating space 30 therebetween.

As is conventional the inner vessel and outer vessel are secured together by welded, e.g., ultrasonically welded, joint (not shown) at their top portions to isolate the annular space 30 from the ambient atmosphere. With the foregoing arrangement the inner vessel 24 of the bottle assembly 20 is thermally insulated from the ambient atmosphere. Thus, any type of liquid, e.g., cold water or soda, hot tea or coffee, etc., can be held within the inner vessel to maintain its temperature.

The lid assembly of the bottle includes a threaded portion that is arranged to be screwed on to corresponding threads 32 of the bottle assembly 20 to close off the top of the bottle assembly. The lid assembly can be of any suitable construction, e.g., it can include a pivotable cap, to enable a person to fill the bottle when desired and to take a drink or pour from the bottle when desired by merely flipping the cap up.

The decorative wrap 26 will be described shortly. Suffice it for now to state that it is designed to be disposed within the annular space 30 of the bottle assembly to provide an aesthetically pleasing appearance for the bottle. To that end, as is conventional the sidewall of the outer vessel 22 is transparent or translucent or includes a portion or window which is transparent or translucent so that the decorative wrap 26 is visible through it. In accordance with one exemplary and preferred embodiment of this invention the inner and outer vessels are both formed of a transparent material. Any suitable transparent plastic material can be used. For example, Eastman Tritan™ copolyester sold by Eastman Chemical Company is one particularly desirable transparent material.

As is also conventional the decorated wrap 26 is formed of a thin flexible material, e.g., polyester film, which is curled or rolled up into a generally cylindrical shape so that it can be inserted into the annular space 30 and thus be visible through the sidewall of the outer vessel 22. The wrap 26 is "decorative" in that it includes any type of decoration 34 on it. For example, the decoration may be in the form of any type of graphics printed or otherwise applied on the wrap so that the graphics are visible from the outer surface of the wrap. In the exemplary embodiment the decoration 32 is in the form of a graphic array composed of multiples of text bearing the name and trademark of the assignee of this invention. It should be pointed out at this juncture, that if the decoration is in the form of graphics, such graphics need not be printed on the outer surface of the wrap, but could be printed on its inner surface if the wrap is formed of a transparent, semitransparent or translucent to enable the graphics be visible through the wrap. Alternatively to having graphics on the wrap, or in addition to the inclusion of graphics on the wrap, the outer surface of the wrap may be in the form of an aesthetically pleasing textured, e.g., speckled, glittered, etc., surface. Further still, if desired, the wrap may include decoration 34 which is visible through the sidewall of the inner vessel, so that it can be seen when looking into the interior of the inner vessel.

As shown in FIG. 10, the decorated wrap 26 is disposed within the annular space 30 of the bottle assembly, with its outer surface facing the inner surface of the sidewall of the outer vessel. Thus, the decoration 32 will be visible through that sidewall.

Unlike conventional decorated wraps for decorating double walled vessels, the wrap 26 of this invention is constructed as shown in FIG. 2 to include projecting tabs (to be described shortly) which cooperate with portions of the inner vessel to hold the wrap in place. In particular, those tabs are arranged to cooperate with stops located at the ends of channels or notches (also to be described shortly) on the inner vessel 24 to prevent the wrap from rotating around the central longitudinal axis 28 within the annular space 30. Thus, the decoration of the wrap can be consistently positioned within a small tolerance in the annular space during the manufacturing process. This feature is of considerable importance in many applications, particularly if the decoration of the wrap doesn't extend about the full periphery of the vessel and is desired to be located at a particular position with respect to the periphery of the bottle assembly. For example, if the decoration on the wrap consists of a sport's team logo, mascot, etc., that is located only at one or plural positions on the wrap, and that logo is to be aligned or otherwise positioned at a desired location with respect to some portion of the bottle assembly 20, e.g., the cap of the lid (not shown), the tabs and cooperating stops will prevent the wrap from rotating from that desired position.

As can best be seen in FIG. 2 the upper edge 40 of the wrap 26 includes a pair of tabs 36A and 36B which project outward from that edge. The tabs are spaced from each other so that when the wrap is rolled up and inserted within the annular space 30 so that its side edges 42 abut, the tabs will be located almost diametrically opposite each other as can clearly be seen in FIG. 10. Moreover, before insertion of the wrap in the annular space 30 of the vessel 20, both of its tabs 36A and 38A are bent out of the plane of the wrap 26 to extend at an acute angle as shown in FIG. 9. Thus, when the wrap is located within the annular space 30, the free end 48 of each tab is located radially inward from the wrap and closer to the central longitudinal axis 28. In particular, in the exemplary embodiment shown herein, the free end 48 of the angled tab 36A is located within a notch or channel 44A extending along a portion of the outer periphery of the top portion of the inner vessel 24. The notch or channel 44A extends for approximately one half of the periphery of the inner vessel where the notch or channel is located. One end of that notch or channel 44A is in the form of a projection or stop 38A, while the other end of the notch or channel is in the form of a projection or stop 38B. As best seen in FIGS. 5 and 6, the free end 48 of the tab 36A is located within the notch or channel 44A immediately adjacent the stop 38A. In a similar manner the free end 48 of the angled tab 36B is also located within the notch or channel 44A, but immediately adjacent the stop 38B, as best seen in FIGS. 7 and 8.

When the wrap is so located the stop 38A will prevent the wrap 26 from rotating about the central longitudinal axis 28 in the clockwise direction of FIG. 10 by virtue of the angularly extending tab 36A engaging that stop. In a similar manner the stop 38B will prevent the wrap from rotating about central longitudinal axis 28 in the counterclockwise direction by virtue of the angularly extending tab 36B engaging that stop. Accordingly, the wrap will be effectively locked in position in the annular recess.

In accordance with a preferred embodiment of this invention, the inner vessel includes a second notch or channel 44B, constructed similarly to the notch or channel 44A. The stop 38A forms one end of the notch or channel 44B and the stop 38B forms the other end of the notch or channel 44B. If desired, the decorated wrap 26 can be constructed and disposed within the annular space 30 so that its tabs 36A and 36B are located within the notch or channel 44B, with the stops 38A and 38B acting in a similar manner to prevent rotation of the wrap about the central longitudinal axis 28.

As should be appreciated by those skilled in the art, the channels 44A and 44B and their associated notches or channels need not be a portion of the inner vessel. Thus, it is contemplated that they can form a portion of the outer vessel so long as the tabs of the wrap can engage the stops to prevent rotation of the wrap about the central longitudinal axis of the bottle. Moreover, the tabs 36A and 36B need not be located along the top edge 40 of the wrap 26. Thus, it is contemplated that the bottom edge 46 of the wrap may include the projections 36A and 36B. In such a case the notches/stops will be located on either the inner vessel or the outer vessel (as the case may be) adjacent to bottom of the bottle instead of being at the top like that described above. Further still, while the use of the notches or channels is preferred, it is contemplated that other arrangements can be used to receive respective tabs to serve as stops preventing the rotation of the wrap about the central longitudinal axis.

Without further elaboration the foregoing will so fully illustrate our invention that others may, by applying current or future knowledge, adopt the same for use under various conditions of service.

We claim:

1. A decorated drinking vessel comprising an inner vessel, an outer vessel and a decorated insert, said inner vessel having a circular sidewall extending about a central longitudinal axis and having an outer surface, said outer vessel having a circular sidewall extending about said central longitudinal axis and having an inner surface, said inner vessel being disposed within said outer vessel with said outer surface of said inner vessel spaced from said inner surface of said outer vessel to form a hollow annular space therebetween, said annular space including a first stop member projecting therein and a second stop member projecting therein, said first stop member having a first side facing in a first circumferential direction, said second stop member having a first side facing in a second circumferential direction, said second circumferential direction being opposite said first circumferential direction, said decorative insert being a curved member having a top edge portion and a bottom edge portion, one of said top edge portion and said bottom edge portion having a first tab projecting therefrom and a second tab projecting therefrom, said first tab being configured to engage said first stop member on said first side of said first stop member and said second tab being configured to engage said second stop member on said first side of said second stop member, whereupon said first and second tabs are interposed between said first side of said first stop member and said first side of said second stop member such that said decorative insert is held in place within said annular space and precluded from rotating about said central longitudinal axis.

2. The decorated drinking vessel of claim 1 wherein each of said first and second tabs extends at an angle toward said central longitudinal axis.

3. A decorated drinking vessel comprising an inner vessel, an outer vessel and a decorated insert, said inner vessel having a circular sidewall extending about a central longitudinal axis and having an outer surface, said outer vessel having a circular sidewall extending about said central longitudinal axis and having an inner surface, said inner vessel being disposed within said outer vessel with said outer surface of said inner vessel spaced from said inner surface of said outer vessel to form a hollow annular space therebetween, said annular space including a first stop member projecting therein and a second stop member projecting therein, said decorative insert being a curved member having a top edge portion, a bottom edge portion, and first and second tabs located at said top edge portion, said first tab being configured to engage said first stop member on one side of said first stop member and said second tab being configured to engage said second stop member on a corresponding side of said second stop member, whereupon said decorative insert is held in place within said annular space and precluded from rotating about said central longitudinal axis.

4. The decorated drinking vessel of claim 2 wherein said first and second tabs are located at said top edge portion of said decorative insert.

5. The decorated drinking vessel of claim 1 wherein said outer vessel includes a portion that is transparent, whereupon said decorated insert can be viewed therethrough.

6. The decorated drinking vessel of claim 3 wherein said outer vessel includes a portion that is transparent, whereupon said decorated insert can be viewed therethrough.

7. The decorated drinking vessel of claim 1 wherein said annular space is sealed to form an insulating space between said inner and outer vessel.

8. The decorated drinking vessel of claim 3 wherein said annular space is sealed to form an insulating space between said inner and outer vessel.

9. The decorated drinking vessel of claim 1 wherein said inner vessel includes a notch or channel extending along a portion of the periphery of said sidewall of said inner vessel, said one side of said first stop member forming one end of said notch or channel, said corresponding side of said second stop member forming the opposite end of said notch or channel.

10. The decorated drinking vessel of claim 9 wherein said notch or channel extends for approximately one half of the periphery of the inner vessel where said notch or channel is located.

11. The decorated drinking vessel of claim 2 wherein said inner vessel includes a notch or channel extending along a portion of the periphery of said sidewall of said inner vessel, said one side of said first stop member forming one end of said notch or channel, said corresponding side of said second stop member forming the opposite end of said notch or channel, said first angled tab having a free end extending into said notch or channel, said second angled tab having a free end extending into the said notch or channel.

12. The decorated drinking vessel of claim 11 wherein said notch or channel extends for approximately one half of the periphery of the inner vessel where said notch or channel is located.

13. The decorated drinking vessel of claim 1 wherein said inner vessel includes a pair of notches or channels, each of said notches or channels extending for approximately one half of the periphery of the inner vessel where said notches or channels are located, said one side of said first stop member forming one end of one of said pair of notches or channels, said corresponding side of said second stop member forming the opposite end of said one of said pair of notches or channels, said first stop member having a side opposite said one side, said second stop member having a side opposite said corresponding side, said side opposite said one side of said first stop member forming one end of the other of said pair of notches or channels and said side opposite said corresponding side of said second stop member forming the opposite end of the other of said pair of notches or channels, said first tab having a free end extending into one of said pair of notches or channels, said second tab having a free end extending into said one of said pair of notches or channels.

14. The decorated drinking vessel of claim 3 wherein each of said first and second tabs extends at an angle toward said central longitudinal axis.

* * * * *